US009604767B2

(12) United States Patent
Ramsuer

(10) Patent No.: US 9,604,767 B2
(45) Date of Patent: Mar. 28, 2017

(54) CARTON WITH CARRYING HANDLE AND BLANK THEREFOR

(71) Applicant: MeadWestvaco Packaging Systems, LLC, Richmond, VA (US)

(72) Inventor: Brandon L. Ramsuer, Henrico, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/425,370

(22) PCT Filed: Aug. 31, 2013

(86) PCT No.: PCT/US2013/057746

§ 371 (c)(1),
(2) Date: Mar. 3, 2015

(87) PCT Pub. No.: WO2014/036536

PCT Pub. Date: Mar. 6, 2014

(65) Prior Publication Data

US 2015/0232247 A1 Aug. 20, 2015

Related U.S. Application Data

(60) Provisional application No. 61/696,259, filed on Sep. 3, 2012.

(51) Int. Cl.

| | |
|---|---|
| ***B65D 5/46*** | (2006.01) |
| ***B65D 71/36*** | (2006.01) |
| ***B65D 5/468*** | (2006.01) |

(52) U.S. Cl.
CPC ..... *B65D 71/36* (2013.01); *B65D 5/4608* (2013.01)

(58) Field of Classification Search
CPC ..... B65D 5/4608; B65D 71/36
(Continued)

(56) References Cited

U.S. PATENT DOCUMENTS 2,718,301 A 9/1955 Palmer
3,593,849 A 7/1971 Helms et al.
(Continued)

FOREIGN PATENT DOCUMENTS

GB 1103372 2/1968
GB 1602857 11/1981
(Continued)

OTHER PUBLICATIONS

International Search Report from PCT/US2013/057746 dated Nov. 29, 2013.

*Primary Examiner* — Gary Elkins
(74) *Attorney, Agent, or Firm* — WestRock Intellectual Property Team

(57) ABSTRACT

A carton includes a top panel, a first side panel and a slot handle. The slot handle includes a line of separation extending across the top panel at a location spaced from the longitudinal center of the top panel. The slot handle includes a lifting edge spaced from the line of separation and disposed on one side of the line of separation. The slot handle further includes a first stress relief mechanism provided in the first side panel. The first stress relief mechanism includes a frangible line having a linear stem section that is acutely angled relative to a notional line normal to the hinged connection between the top panel and the first side panel. The stem section is angled away from the lifting edge and terminating in an arcuate stop at a location spaced below the hinged connection on the one side of the line of separation.

17 Claims, 6 Drawing Sheets

(58) Field of Classification Search
USPC ..... 229/117.12, 117.13; 206/427, 434
See application file for complete search history.

(56) References Cited

U.S. PATENT DOCUMENTS

| | | | | | |
|---|---|---|---|---|---|
| 4,684,059 | A * | 8/1987 | Rusnock | B65D 5/4608 | 206/141 |
| 4,784,316 | A * | 11/1988 | Crouch | B65D 5/4608 | 206/141 |
| 4,811,894 | A | 3/1989 | Schuster | | |
| RE33,110 | E * | 11/1989 | Wood | B65D 5/4608 | 206/141 |
| 4,966,324 | A | 10/1990 | Steel | | |
| 4,981,253 | A | 1/1991 | Quaintance | | |
| 5,106,014 | A * | 4/1992 | Miller | B65D 5/4608 | 229/117.12 |
| 5,222,658 | A * | 6/1993 | DeMaio | B65D 5/4608 | 206/427 |
| 5,794,778 | A * | 8/1998 | Harris | B65D 71/36 | 206/428 |
| 6,273,330 | B1 * | 8/2001 | Oliff | B65D 71/30 | 229/117.12 |
| 6,997,316 | B2 * | 2/2006 | Sutherland | B65D 71/36 | 206/427 |
| 7,918,384 | B2 * | 4/2011 | Gomes | B65D 71/36 | 229/122 |
| 8,348,142 | B2 * | 1/2013 | Smalley | B65D 71/36 | 229/117.14 |
| 8,733,623 | B2 | 5/2014 | Beales et al. | | |
| 9,096,344 | B1 * | 8/2015 | Block | B65D 5/542 | |
| 9,211,971 | B2 * | 12/2015 | Fogle | B65D 5/4204 | |
| 9,266,656 | B2 | 2/2016 | Walling et al. | | |
| 2004/0188300 | A1 | 9/2004 | Sutherland | | |
| 2007/0017962 | A1 * | 1/2007 | Russ | B65D 5/0227 | 229/117.13 |
| 2009/0057384 | A1 * | 3/2009 | Learn | B65D 71/36 | 229/117.16 |

FOREIGN PATENT DOCUMENTS

| | | |
|---|---|---|
| WO | WO 88/09750 | 12/1988 |
| WO | WO 2006/127734 A1 | 11/2006 |
| WO | WO2009082724 A1 | 7/2009 |
| WO | WO 2012/129130 | 9/2012 |
| WO | WO 2012/129130 A1 | 9/2012 |

* cited by examiner

CARTON WITH CARRYING HANDLE AND BLANK THEREFOR

CROSS-REFERENCE TO RELATED APPLICATIONS

This application is a National Phase application of PCT Application PCT/US13/057746, filed Aug. 31, 2013, which claims the benefit of U.S. Provisional Patent Application No. 61/696,259, filed Sep. 3, 2012, each of which is incorporated herein by reference in its entirety.

FIELD OF THE INVENTION

The present invention relates to a carrying handle for a carton, more specifically, but not exclusively to a carrying handle disposed off-centre of the carton and even more specifically but not exclusively to a carrying handle for a carton containing cans.

BACKGROUND OF THE INVENTION

In the field of packaging it is often required to provide consumers with a package comprising multiple primary product containers, such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is known to form slot handles in cartons. For example in WO2009/082724 a slot handle for a carton containing cans disposed on their sides is shown. In this and other slot handles, a cut or perforation is made across the carton, in line with the height of a can and positioned close to a gap between adjacent cans. As such, slot handles are typically advantageous because no additional material other than that already present in the carton structure is required to form them. Slot-handles are typically formed in the centre of a carton and a user can typically grasp either edge of a slot for carrying the carton. As such a typical slot-handle is not "handed" and a user does not need to orient the carton in a "correct" way before being able to lift the carton. Slot handles are therefore further advantageous since they are easy to use.

The present invention seeks to provide an improvement in the field of slot handles by providing a slot-handle arrangement that can be formed in an off-centre position within the carton. In such an arrangement a user can hold the carton at an angle, which may optionally offer a more comfortable carrying position. In such an arrangement the stresses imparted into the carton and the stress points that can be created are different dependent upon the way in which the carton is being carried. For the off-centre handle to be robust and strong enough, the present invention provides a stress relief mechanism. In this way a strong off-centre slot-type-handle is provided. Such a handle arrangement may be advantageous for example where there are other features, such as an access opening present on the carton and off-setting the handle is advantageous to avoid interference between the handle and the other features, such as the opening feature.

SUMMARY OF INVENTION

According to a first aspect of the present invention there is provided a carton comprising a top panel and a first side panel and comprising a slot handle formed in the top panel and the first side panel, the slot handle comprising a line of separation extending at least substantially transversely across the top panel of the carton at a location that is spaced from the longitudinal centre of the top panel such that the length of the top panel on a short side of the line of separation is less than the length of the top panel on a long side of the line of separation, the slot handle comprising a lifting edge that is spaced from the line of separation and that is disposed on the short side of the line of separation, and the slot handle further comprising a stress relief mechanism provided in the first side panel, the stress relief mechanism comprising a cut stem that is acutely angled, relative to a notional line disposed normal to the hinged connection between the top panel and the first side panel; that is angled away from said lifting edge; and that terminates in an arcuate stop at a location spaced below the hinged connection between the top panel and the first side panel on the short side of the line of separation.

According to a second aspect of the invention for which protection is sought, there is provided a blank for forming a carton comprising a slot handle, the blank comprising a series of interconnected panels for forming the carton including a top panel and a first side panel, wherein the slot handle is formed in the top panel and the first side panel, the slot handle comprising a line of separation extending at least substantially transversely across the top panel at a location that is spaced from the centre of the top panel such that the length of the top panel on a short side of the line of separation is less than the length of the top panel on a long side of the line of separation, the slot handle comprising a lifting edge that is spaced from the line of separation and that is disposed on the short side of the line of separation, and the slot handle further comprising a stress relief mechanism provided in the first side panel, the stress relief mechanism comprising a cut stem that is acutely angled, relative to a notional line disposed normal to the hinged connection between the top panel and the first side panel; that is angled away from said lifting edge; and that terminates in an arcuate stop at a location spaced below the hinged connection between the top panel and the first side panel on the short side of the line of separation.

Optionally, the carton or blank comprises a second side panel and wherein the slot handle extends into the second side panel and said slot handle further comprises a stress relief mechanism provided in the second side panel, said stress relief mechanism in the second side panel comprising a cut stem that is acutely angled, relative to a notional line disposed normal to the hinged connection between the top panel and the second side panel, that extends away from said lifting edge and that terminates in an arcuate stop at a location spaced below the hinged connection between the top panel and the second side panel on the short side of the line of separation.

Optionally, the arcuate stop of the relief mechanism in the first and/or second side panel is substantially semi-circular and returns relative to the cut section an angle greater than 90°.

Optionally, the arcuate stop of the relief mechanism in the first and/or second side panel comprises a straight end that is at least substantially parallel to the acutely angle stem section.

Optionally, the relief mechanism in the first and/or second side panel comprises one or more relief cuts or weakened lines that starts at a location proximate a hinged connection between the top panel and the first side panel on the long side of the line of separation and continues into said stem section.

Optionally, the acute angle of the stem section of the stress relief mechanism in the first and/or second side panel is greater than 0° and less than or equal to about 45°.

Optionally, the acute angle of the stem section of the stress relief mechanism in the first and/or second side panel is between about 10° and about 20°.

Optionally, the acute angle of the stem section of the stress relief mechanism in the first and/or second side panel is about 15°.

Optionally, the acute angle of the stem section of the relief mechanism in the first and/or second side panel is determined in dependence upon the approximate ratio between the length of the top panel on the short side of the line of separation and the length of the top panel on the long side of the line of separation.

Optionally, the one or more relief cuts or weakened lines in the first and/or second side panel comprises one or more or a combination of: a curvilinear crease-cut section, a curved cut line, and a connecting nick portion and wherein the stem section and the arcuate stop are provided by a J-shaped cut line.

Optionally, the one or more relief cuts or weakened lines in the first and/or second side panel comprises a linked series comprising a curvilinear crease-cut section which starts with a substantially linear crease section at a location proximate an hinged connection between the top panel and the first or second side panel on the long side of the line of separation and continues into a curved cut line, which curvilinear crease-cut section is separated from a further curved cut line by a connecting nick portion, the further curved cut line extends from the long side of the line of separation to the short side of the line of separation and terminates in a further connecting nick portion, the series is completed by said J-shaped cut line.

Optionally, the arcuate stop in the first and/or second side panel turns towards the short side of the line of separation.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Figure 1:
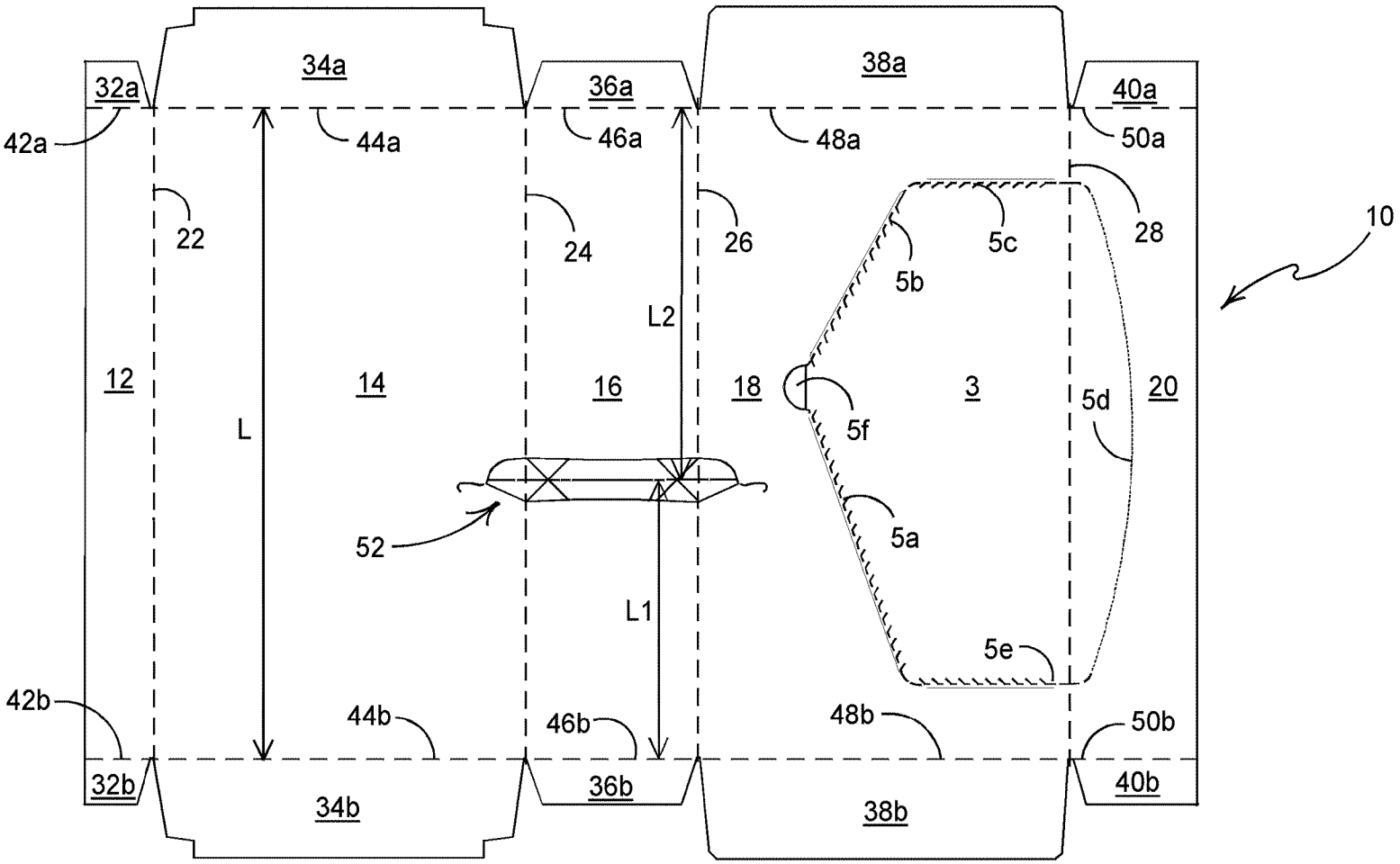
FIG. 1. is a plan view of a blank for forming a carton having an off-centre slot-type handle according to an embodiment of the invention.

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms carton and carrier refer, for the non-limiting purpose of illustrating the various features of the invention, to a container for engaging, carrying, and/or dispensing articles, such as cans. However, it is contemplated that the teachings of the invention can be applied to various containers, which may or may not be uniformly cylindrical and which may be tapered or otherwise shaped. Other exemplary articles include bottles (for example metallic, glass or plastics bottles), cans (for example aluminium cans), tins, pouches, packets and the like. It is however preferable for the proper operation of the slot-type handle of the invention if the articles are capable of providing a bracing force across the width of the carton. As such, the slot-type handle of the present disclosure lends itself well to carton applications where the cartons are for containing cans, but it will be understood that other applications of the slot-type handle of the present disclosure are envisaged.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carrier structure described in more detail below.

In the exemplary embodiment, the blank is configured to form a carton 100 or carrier for packaging an exemplary arrangement of exemplary articles. For example, the arrangement is a matrix including rows and columns such as a 3×5 arrangement of cans. The blank 10 can be alternatively configured to form a carrier for packaging other articles and/or different arrangements of articles.

Referring again to FIG. 1, there is shown a blank 10 for forming a carton 100 of the fully enclosed end-loading type. It will be recognised that the carrying handle arrangement described and illustrated here in the context of such a carton 100 should not be construed to limiting the carrying handle arrangement to only that application and it is specifically envisaged that the carrying handle arrangement described and illustrated herein may be applied to other suitable carton types and configurations.

The blank 10 comprises an interconnected series of main panels including: first bottom panel 12, first side panel 14, top panel 16, second side panel 18 and second bottom panel 20. The main panels are hinged together one to the next in series by longitudinally extending fold lines 22, 24, 26, 28. The ends of the carton 100 are at least partially closed by composite end wall structures that are formed by a series of end closure panels hinged to the main panels. These include: first bottom end closure panels 32*a*, 32*b*, hinged along transverse fold lines 42*a*, 42*b* to the first bottom panel 12; first side end closure panels 34*a*, 34*b* hinged along transverse fold lines 44*a*, 44*b* to the first side panel 14; top end closure panels 36*a*, 36*b* hinged along transverse fold lines 46*a*, 46*b* to the top panel 16; second side end closure panels 38*a*, 38*b* hinged along transverse fold lines 48*a*, 48*b* to the second side panel 18; and second bottom end closure panels 40*a*, 40*b* hinged along transverse fold lines 50*a*, 50*b* to the second bottom panel 20.

Optionally an access feature may be provided, in the illustrated arrangement an optional tear-out feature 3 is provided, which is defined by a series of connected perforate, frangible or otherwise weakened lines 5*a*, 5*b*, 5*c*, 5*d*, 5*e* and an initiator tab 5*f*. The access feature is provided so that a user can easily gain controlled access to the articles without destroying the structural integrity of the carton 100 such that the carton 100 may still contain remaining articles. It will be recognised that the access feature is entirely optional. In other embodiments, no access feature is provided. In yet further envisaged embodiments, other suitable access features are provided. As can be seen in the presently described optional embodiment, the access feature 3 defines a significant area of the second side panel 18. Such an access feature is intended to be used when the carton 100 is oriented on its first side panel 14 and an opening is created though which articles, such as cans, 'C', may be accessed. The size, shape and general configuration of the access feature 3 may be a consideration in the positioning of the slot-type handle 52 in an off-centre position. In the relative positions shown, the slot-type handle 52 is spaced from the access feature 3, particularly the initiator 5*f* thereof such that the two features do not interfere with each other's operation. In this way inadvertent initiation of the access feature by a user employing the carrying handle is avoided.

Figure 1A:
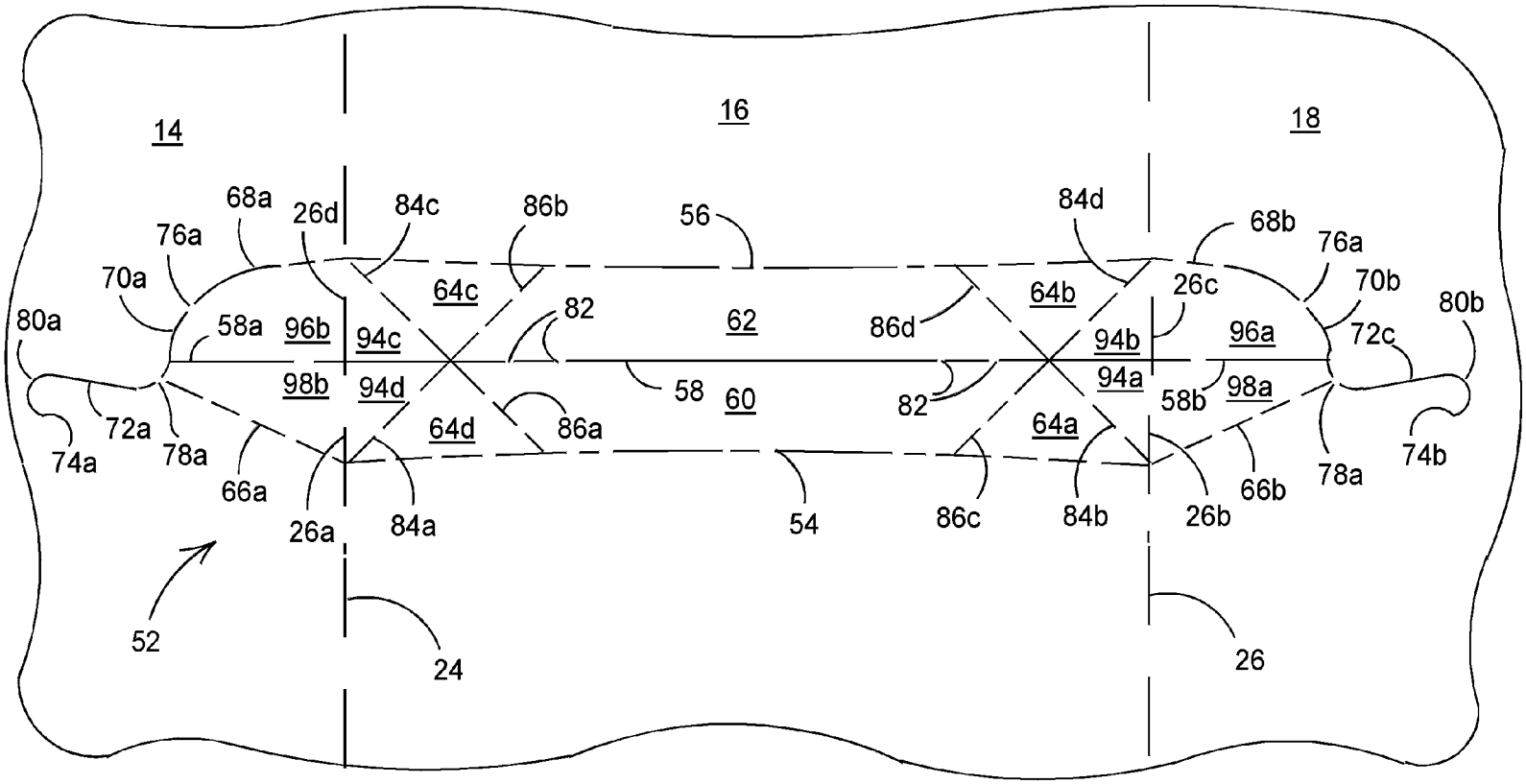
FIG. 1A. is an enlarged view of the off-centre slot-type handle shown in FIG. 1.
Figure 2:
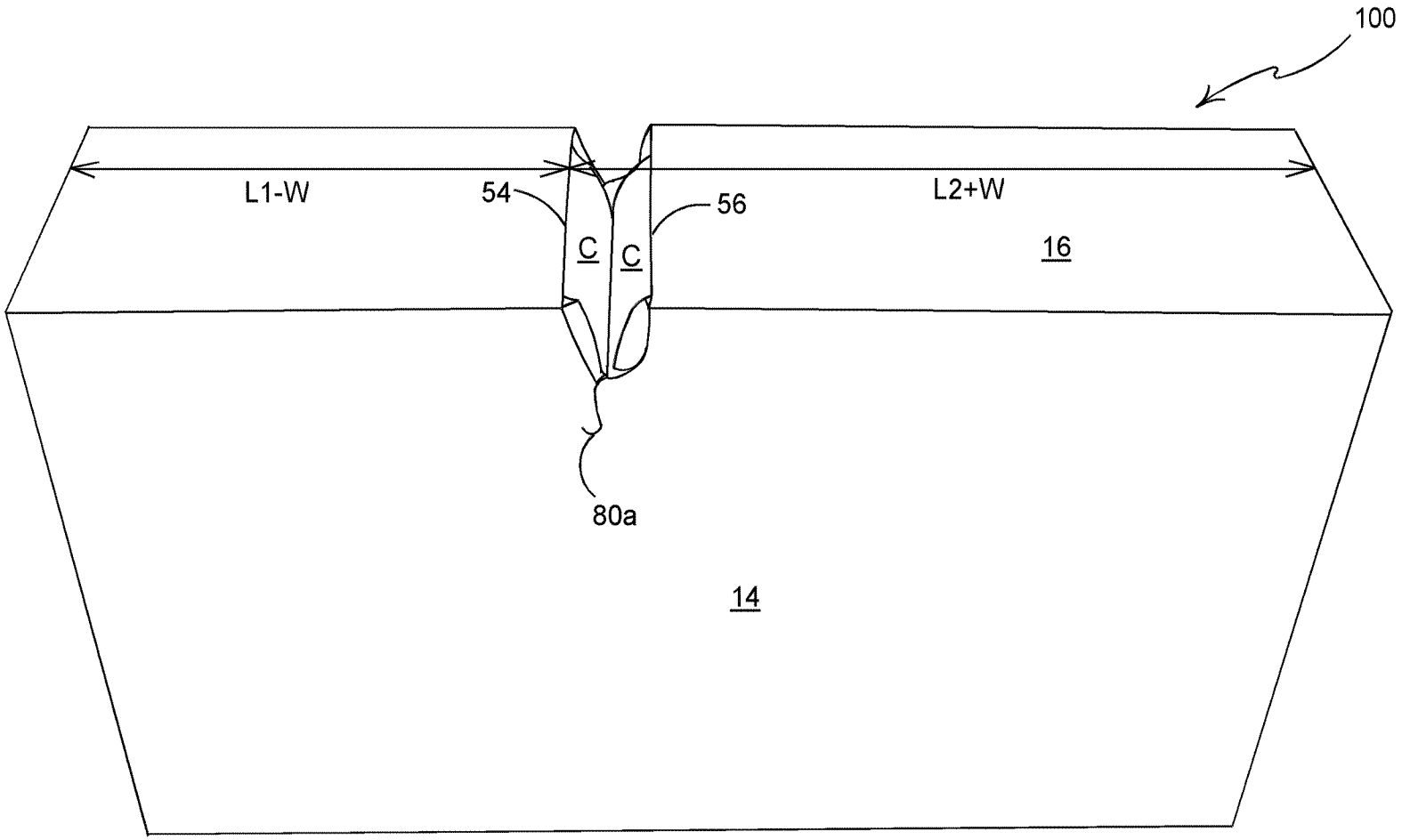
FIG. 2. is a perspective view from above of a carton formed from the blank of FIG. 1 showing the carrying opening formed in the carton by the off-centre slot handle.
Figure 3:
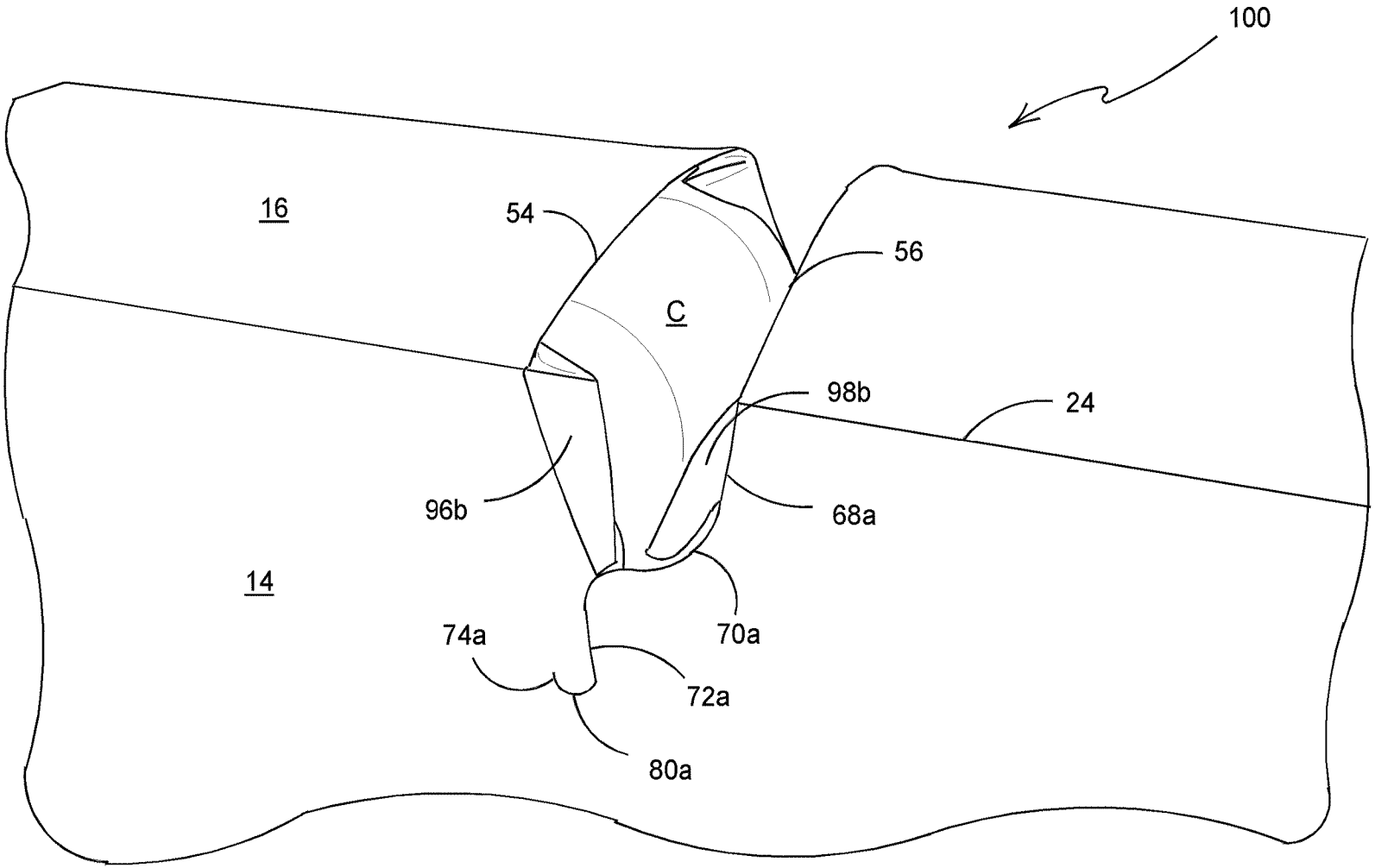
FIG. 3. is a close-up view of the carton of FIG. 2.

It can be seen that the slot handle 52 is disposed closer to the right hand side of the blank 10 than it is to the left hand side of the blank 10 when viewed in FIG. 1. In FIG. 1A, an enlarged view of the slot handle 52 is shown wherein the various elements of the slot handle 52 have been numbered. A line of separation 58 defines the centre of the slot handle 52. Referring back to FIG. 1, it is shown that the line of separation 58 is spaced a longitudinal distance L1 from the right-hand end of the top panel 16 (defined by fold line 46*b*) and that the line of separation 58 is spaced a longitudinal distance L2 from the left-hand end of the top panel 16 (defined by fold line 46*a*). Preferably, but nevertheless optionally, the slot handle 52 is disposed in an off-centre position such that L1≠L2. Optionally in other embodiments, the slot handle 52 may be disposed in an at least substantially central position, wherein L1≈L2. Preferably however, the slot handle 52 is disposed in an off-centre position such that either L2>L1 or L1>L2. In the illustrated arrangement, the carton 100 is suitable for holding cans 'C' of diameter 'd' in 4 rows of 7 cans 'C' each. L1 is approximately equal to 3×d whereas L2 is approximately equal to 4×d. The line of separation 58 is positioned such that when the blank 10 is formed into a carton 100 (see FIGS. 2 and 3) the line of separation 58 is formed above a gap between two adjacent cans 'C'.

Referring now to FIG. 1A, it can be seen that the line of separation 58, 58*a*, 58*b* extends into each of the adjacent first and second side panels 14, 18. In other embodiments, the slot handle 52 may extend into only one of the adjacent first and second side panels 14, 18. The line of separation 58, 58*a*, 58*b* is optionally a perforate cut line comprising one or more or a series of connecting nick portions 82. For example, six connecting nick portions are provided along the line of separation 58 in the top panel 16; one nick portion is provided along the line of separation 58*a* in the first side panel 14; one nick portion is provided along the line of separation 58*b* in the second side panel 18; one nick portion is provided at the intersection between the line of separation 58, 58*a* and the longitudinally extending hinged connection or fold line 24; and one nick portion is provided at the intersection between the line of separation 58, 58*b* and the longitudinally extending hinged connection or fold line 26.

Spaced either side of the main line of separation 58 and within the top panel 16 a pair of fold lines 54, 56 define each of the lifting edges of the slot handle 52. Between fold line 54 and line of separation 58 a cushioning flap 60 is formed, likewise, between fold line 56 and line of separation 58 a cushioning flap 62 is formed. Preferably the width of the cushioning flaps is controlled such that when folded beneath the plane of the top panel 16, the cushioning flap can fold within the gap between the top panel 16 and the two adjacent cans 'C' and at least partially underneath the top panel 16 (see FIG. 2).

At each end of each cushioning flap 60, 62 pairs of gussets are formed by crossed fold lines 86*a*/84*c*, 86*b*/84*a*; 86*c*/84*d*, 86*d*/84*b*. Optionally the fold lines 86*a*/84*c*, 86*b*/84*a*; 86*c*/84*d*, 86*d*/84*b* are disposed at least substantially at 90° relative to one another. Inner gusset panels 64*a*, 64*b*, 64*c*, 64*d* are spaced further from the fold lines 26, 24 than the outer gusset panels 94*a*, 94*b*, 94*c*, 94*d*. Inner gusset panels 64*a*, 64*b*, 64*c*, 64*d* are defined by sections of the fold lines 56, 58; and by fold lines 84*b*, 86*c*; 84*d*, 86*d*; 86*b*, 84*c*; and 86*a*, 84*a*. Outer gusset panels 94*a*, 94*b*, 94*c*, 94*d* are defined by sections 26*b*, 26*c*, 26*d*, 26*a* of the longitudinally extending fold lines 26, 24; by fold lines 84*b*, 84*d*, 84*c*, 84*a*; and by the line of separation 58.

At each end of the slot handle 52 a stress relief mechanism is provided which is tailored and configured to mitigate against stress build up or localised stress points in the carton 100 structure when the carton 100 is carried by the slot handle 52, in either direction (i.e. by using edge 54 or 56).

The stress relief mechanisms (also referred to as relief cuts) are identical and therefore only one will be described, it being understood that the details provided regarding one end of the slot handle 52 are also true in respect of the other end of the slot handle 52.

A weakened line or 68*b*, 70*b* extends from the intersection of fold lines 56, 84*d* and 26*c*. The weakened line 68*b*, 70*b* may comprise a substantially straight crease 68*b* extending from the intersection and a full-depth curvilinear cut line 70*b* extending between the straight crease 68*b* and a substantially J-shaped frangible line 72*c*, 80*b*, 74*b*. A connecting nick portion 76*a* is provided along the curvilinear cut line 70*b* to interrupt the cut line 70*b*. The connecting nick portion 76*a* provides a connection between end section 96*a* (defined by the weakened line 68*b*, 70*b*, line of separation 58*b*; and fold line 26*c*) and the second side panel 18. The curved cut line 70*b* extends from the straight crease 68*b*, across and spaced from the termination of line of separation 58*b* and toward a further nick portion 78*a*. From the further nick portion 78*a* a linear crease line 66*b* extends back toward the intersection between fold lines 54, 26*b* and 84*b*, to thereby define a section 98*a*. From the further nick portion 78*a*, the substantially J-shaped or hook-shaped frangible line 72*c*, 80*b*, 74*b* is extended. The J-shaped frangible line 72*c*, 80*b*, 74*b* is optionally a full-depth cut line that is not interrupted by any additional connecting nick portions. Optionally, the termination 74*b* of the J-shaped frangible line 72*c*, 80*b*, 74*b* is an arcuate stop that is disposed closer to the fold line 26 than it is to the bottommost part of the J-shaped frangible line 72*c*, 80*b*, 74*b*. Optionally, a linear stem section or straight stretch of the J-shaped frangible line 72*c*, 80*b*, 74*b* extends at an angle of between about 10° and about 15° relative to a notional line normal to fold line 26. Optionally, the arcuate stop or returning arcuate section 80*b* of the J-shaped frangible line 72*c*, 80*b*, 74*b* is at least semi-circular such that the frangible line 72*c*, 80*b*, 74*b* returns about 180°. A straight end portion of the arcuate stop may optionally be provided, which straight end may preferably be positioned parallel to the stem section 72*c*.

Figure 5:
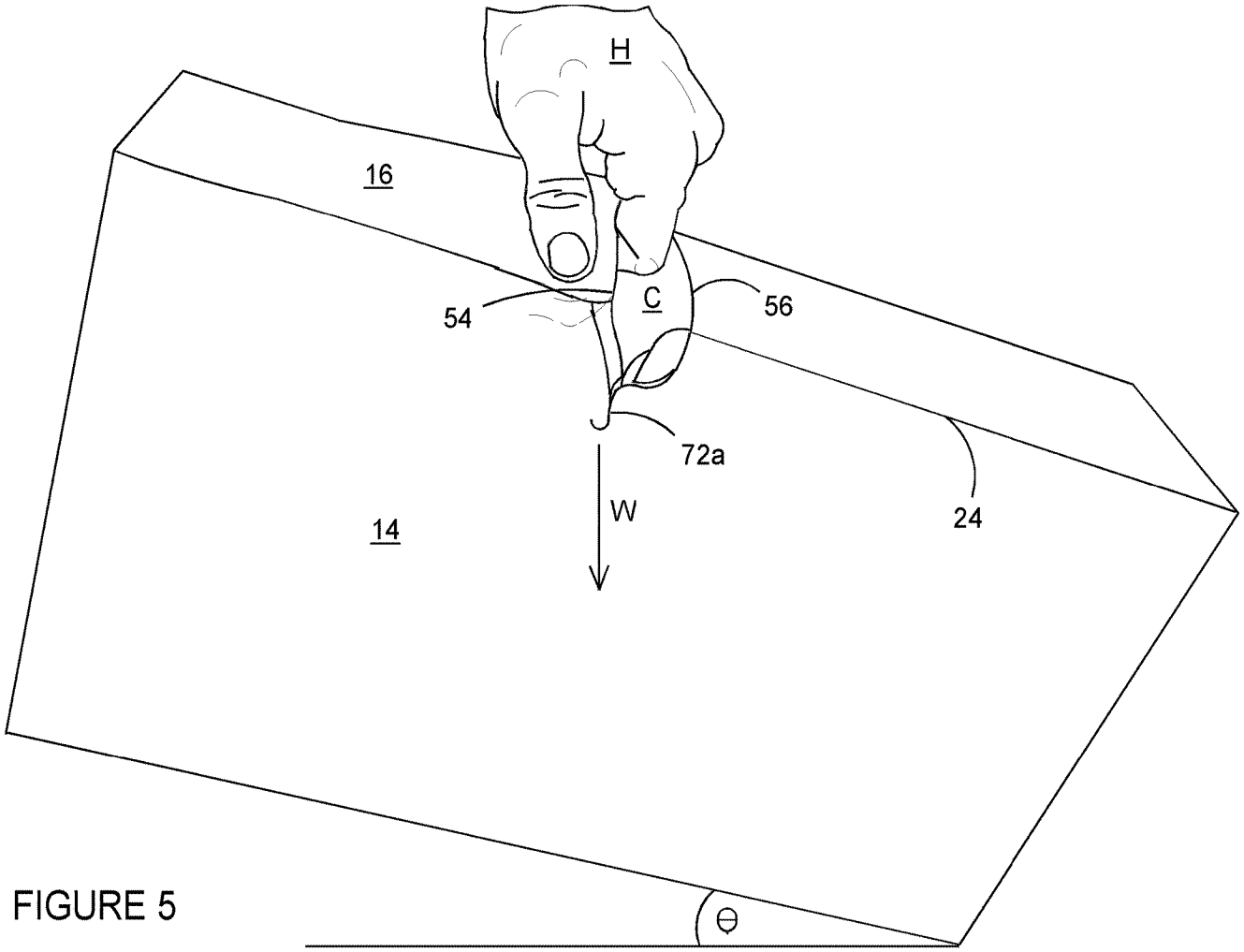
FIG. 5. is a perspective view from above of the carton of FIG. 2 being carried by a user in a second orientation.

Optionally, and as can be seen in FIG. 1A, the straight crease 68*b*, curved or undulated cut line 70*b* and J-shaped frangible line 72*c*, 80*b*, 74*b* define a smoothly curving relief mechanism in spite of the fact that the three sections are separated by connecting nick portions 76*a* and 78*a*. As can be more easily seen in FIGS. 1 and 5, the J-shaped frangible line 72*c*, 80*b*, 74*b* hooks up toward the short section (L1) of the top panel 16. The stem section 72*c* is angled away from the lifting edge 54 disposed on the short side of the line of separation 58.

Turning to the construction of the carton 100 as illustrated in FIGS. 2, 3, 4 and 5 it is envisaged that the carton 100 can be formed by a series of sequential folding operations in a straight line machine so that the carton 100 is not required to be rotated or inverted to complete its construction. The folding process is not limited to that described below and may be altered according to particular manufacturing requirements.

First and second bottom panels 12, 20 are affixed together, optionally by adhesive such as hot melt glue. Other affixing means such as Velcro, staples, mechanical locking mechanisms may alternatively be employed. Optionally the adhesive may be applied to an outside surface of second bottom panel 20. To achieve this, the blank 10 may first be folded about fold line 26 to bring the second side panel 18 and second bottom panel 20 into face contacting overlapping relationship with the top panel 16 and first side panel 14 respectively. An adhesive strip may folded about fold line 22 to bring it into partial overlapping relationship with the second bottom panel 20 such that the first bottom panel 12 becomes affixed to the second bottom panel 20 to form a composite bottom panel 12/20. In this flat-folded part formed condition the blank 10 may be transported to a converting plant, whereat it will be opened into a tubular structure having two open ends. Articles, such as cans 'C' may by loaded though one or both ends of the tubular structure. Preferably for the ease of automation, the open ended tubular carton 100 will be oriented with either the first or second side panel 14, 18 lowermost or bottommost so that the cans 'C' can be pushed into the carton 100 by sliding the cans 'C' along their circular bases.

Once the carton 100 is fully loaded, the composite end walls are formed to close the ends of the carton 100 and secure the cans 'C' inside. The composite end walls are each formed by folding and affixing the end closure panels 32*a*, 34*a*, 36*a*, 38*a*, 40*a*; and 32*b*, 34*b*, 36*b*, 38*b*, 40*b* together. The completed carton 100 may then be oriented such that the bottom panel 12/20 is lower most and the top panel 16 is uppermost. In this orientation the carton 100 can be carried by utilising the slot handle 52.

First, a user must break the line of separation 58. It is envisaged that the line of separation could be a cut line entirely extending across the top panel of the carton; however, it is preferable that the line of separation 58 is a tear line such as a perforation that is not broken until an end user is ready to deploy the handle. In this way, the integrity of the top panel 16 is preserved to prevent the ingress of dust and dirt into the carton 100 and so that the package presented to the customer appears, new and not tampered with.

Once the line of separation 58 is broken, a user can fold back one or both of the cushioning handle flaps 60, 62, which optionally may be folded approximately 180° such that the handle flap 60, 62 is disposed beneath the top panel 16. Either folded edge 54 or 56 can be grasped by the user.

Figure 4:
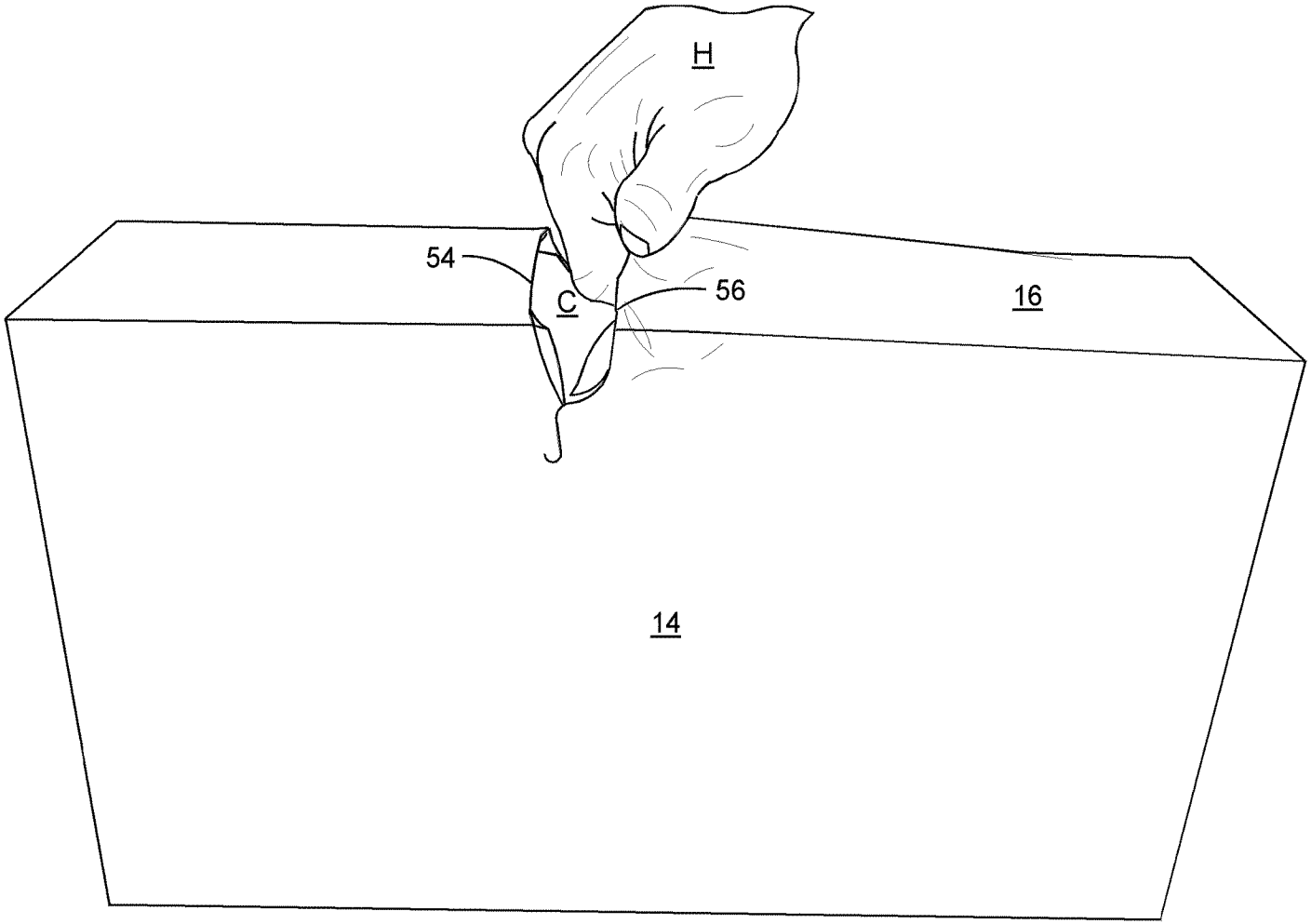
FIG. 4. is a perspective view from above of the carton of FIG. 2 being carried by a user in a first orientation.

When a user grasps edge 56, the user's hand will be tucked towards the centre of the carton 100 (see FIG. 4). The stresses imparted onto the carton 100 are similar to a slot handle centred on the carton 100, because the carton 100 is balanced or held with the top and bottom panels 16, 12/20 at least substantially perpendicular to the downwardly directed force due to the weight (W) of the articles 'C' within the carton. However, when the carton 100 is carried with the hand tucked towards the shorter side of the carton 100 (see FIG. 5) the carton 100 is naturally tilted at an angle □ due to the weight (W) of the carton 100 being greater on the opposite end of the carton 100. This asymmetric weight distribution creates different stress points on the carton 100 when compared to picking the carton 100 up in the other orientation or in a central location. To compensate for the asymmetric distribution of weight on the handle 52, the handle 52 is asymmetrically configured. The relief mechanisms 68*b*, 70*b*, 72*c*, 80*b*, 74*b* assist in re-directing the focal point of the stresses on the carton 100, specifically, the angled stem section 72*c* and arcuate stop 70*b* assist in redistributing the stresses or managing the stress on the handle. Optionally, the acutely angled stem section is formed relative to the weight distribution when the carton 100 is lifted. In the present example:

L2 is greater than L1;

L2 is about 4×'d' (diameter of can 'C')

L3 is about 3×'d'; and

Weight (W) of the carton 100 is distributed in the ratio 3:4 either side of the handle 52;

The slot-type handle 52 is arranged such that when the carton 100 is lifted by the short end (using fold line 54 as the load bearing edge) and the carton 100 tilts at about an angle □, the stem section of the J-shaped frangible line 72*c*, 80*b*, 74*b* becomes more aligned with the direction of the weight (W) of the articles 'C' due to gravity, and therefore may re-direct the stresses on the carton 100 in a manner parallel to the force of gravity.

In the foregoing description, the line of separation 58 has been used to distinguish between a longer section of the top panel having a length L2 and a shorter section of the top panel having a length L1. However, in calculating an appropriate angle of tilt for the stem section 72*c* of the frangible line 72*c*, 80*b*, 74*b*, in other embodiments, consideration may be given to the ratio of the lengths of the top panel that are either side of the load bearing edge 54 that is disposed on the "short side" of the line of separation 58. If each of the handle panels 60, 62 has a width w, then the distance between the load bearing edge 54 and the end of the top panel 16 (defined by fold line 46*b*) is L1−w, and the remaining section of the top panel 16 (including the handle panels 60, 62) is L2+w.

Assuming that the carton 100 will be evenly loaded with articles 'C' across its width, depth and height, then the ratio of the weight on either side of the load bearing edge 54 will be in proportion to the ratio of the distances either side of the load bearing edge 54. The approximate angle θ of tilt that may be adopted by the carton 100 when carried by the load bearing edge 54 can then be calculated and then based on that, the angle of the stem section 72*c* can be determined. As such in other embodiments, the angle of the stem section 72*c* relative to a notional line normal to the fold line 24, 26 (consider a line parallel to cut line 58, 58*a* or 58*b*) may be different from the range suggested for the presently illustrated embodiment of about 10° to about 15°. It will be understood that for a different ratio (L1−w)/(L2+w) between the short side (L1−w) and the long side (L2+w) and/or for a different weight distribution and/or different overall weight that a different angle for the stem section 72*c* may be required for optimum operation. However, it will be understood that when carried, the angle of the carton 100 will change as a user moves and moves the carton 100 and that therefore an angle of greater than 0° and less than or equal to about 45° may be suitable for most of the suitable locations of the short side carrying handle edge 54. For the illustrated carton 100 which comprises cans 'C' in a 4×7 configuration, the most preferred angle is about 10°. Optionally, for a carton configured to accommodate a 4×5 arrangement of cans 'C', the most preferred angle is about 15 degrees. In the 4×7 carton 100, the slot handle 52 is located between a group of 3 cans and the adjacent group of 4 cans. This allows the carton to tilt less significantly than in a 4×5 carton wherein the slot handle is located between a group of 2 cans and the adjacent group of 3 cans. The angle of the stem section 72*c* is optionally a function of the handle 52 location as well as a function of the configuration of the packaged articles.

In either lifting configuration, the top panel 16 is bowed upwardly in relation to its non-lifted plane and optionally, the inner and outer gussets 64*a*, 64*b*, 64*c*, 64*d*, 94*a*, 94*b*, 94*c*, 94*d* are folded to assist with the transfer of the weight of the articles 'C', from the load bearing edge 54, 56 of the handle structure 52 and onto the articles 'C' themselves and/or redistributed across the carton 100 to minimise concentrated points of stress that could otherwise cause the paperboard of the carton 100 to tear. Optionally, the outer gussets 94*a*, 94*b*, 94*c*, 94*d* fold into contact with the adjacent articles 'C' and the inner gussets 64*a*, 64*b*, 64*c*, 64*d* provide a transition between the cushioning flaps 62, 60 and lifting edge 54, 56 of the handle and the portions of the handle structure (including the outer gussets 94*a*, 94*b*, 94*c*, 94*d*) that contact and fold around each end of an adjacent article 'C'. As such, the inner gussets 64*a*, 64*b*, 64*c*, 64*d* may function to prevent the outer gussets 94*a*, 94*b*, 94*c*, 94*d* and optionally end sections 96*a*, 96*b*, 98*a*, 98*b* from experiencing excessive force, which may otherwise occur.

Through well-placed relief mechanisms 68*b*, 70*b*, 80*b*; 68*a*, 70*a*, 80*a*; and/or fold lines and gussets 86*d*, 84*b*, 86*c*, 84*d*, 94*a*, 94*b*, 64*a*, 64*b*; 86*a*, 84*c*, 86*b*, 84*a*, 94*c*, 94*b*, 64*c*, 64*d*; a slot handle 52 of improved strength is provided. The upward lift that is applied to the edges 56 or 54 and top wall 16 is supported by the contact of the outer gussets 94*a*, 94*b*, 94*c*, 94*d* and end portions 96*a*, 98*a*, 96*b*, 98*b* with the ends of the adjacent article C and the relief cuts limit the risk of failure even when the carton 100 is oriented in an asymmetric manner and lifted by an edge disposed more significantly off the centre line of the carton. As such, the forces that are applied through engaging the handle 160 and lifting the carton 100 are distributed and less likely to cause tearing of the carton 100.

It can be appreciated that various changes may be made within the scope of the present invention, for example, the size and shape of the panels and apertures may be adjusted to accommodate articles of differing size or shape. In other embodiments of the invention it is envisaged that in cartons where the handle structure 52 is differently positioned (more or less off-centre) and/or wherein the number, size or configuration of articles is different such that the weight to be supported by the carrying handle 52 is more or less than in the illustrated embodiment, that the relief cuts may be shaped, sized, positioned and angled accordingly. Furthermore, it is also envisaged that the previse shape, size, position and angle of the relief cuts may be varied from the specific arrangement shown whilst employing the benefit of a relief cut angled similarly to the expected tilt of the carton for compensating for that tilt and asymmetric loading on the handle structure.

It is also envisaged that the inner and outer gussets 64*a*, 64*b*, 64*c*, 64*d*, 94*a*, 94*b*, 94*c*, 94*d* and the fold lines 84*a*, 84*b*, 84*c*, 84*d*, 86*a*, 86*b*, 86*c*, 86*d* defining the inner and outer gussets 64*a*, 64*b*, 64*c*, 64*d*, 94*a*, 94*b*, 94*c*, 94*d* are entirely optional and may be omitted from some embodiments and optionally replaced by either an aperture or longer handle flaps 60, 62 for example.

As used herein, the terms "hinged connection" and "fold line" refers to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

As used herein, the term "nick portion" refers to a speck of the sheet material from which the respective carton blank is formed. The "nick portion" interrupts a cut or slit formed in the blank such that the material on one side of the cut or slit is joined or connected by the "nick portion" with the material on the other side of the cut or slit.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A carton comprising a top panel, a first side panel and a slot handle formed in the top panel and the first side panel, the slot handle comprising a line of separation extending at least substantially transversely across the top panel at a location that is spaced from a longitudinal centre of the top panel such that the top panel comprises a long side of the line of separation and a short side of the line of separation wherein the length of the top panel on the short side of the line of separation is less than the length of the top panel on the long side of the line of separation, the slot handle comprising a lifting edge that is spaced from the line of separation and that is disposed on the short side of the line of separation, the slot handle further comprising a first stress relief mechanism provided in the first side panel, the first stress relief mechanism comprising a frangible line having a linear stem section that is disposed at an acute angle relative to a notional line disposed normal to a hinged connection between the top panel and the first side panel, the stem section being angled away from the lifting edge toward the long side of the line of separation and terminating in an arcuate stop at a location spaced below the hinged connection, wherein the first relief mechanism comprises one or more weakened lines that starts at a location proximate the hinged connection and continues into the stem section.

2. A carton according to claim 1 further comprising a second side panel into which the slot handle extends, the slot handle further comprising a second stress relief mechanism provided in the second side panel, the second stress relief mechanism comprising a frangible line having a linear stem section that is acutely angled relative to a notional line disposed normal to a hinged connection between the top panel and the second side panel, the stem section of the second stress relief mechanism extending away from the lifting edge toward the long side of the line of separation and terminating in an arcuate stop at a location spaced below the hinged connection between the top panel and the second side panel.

3. A carton according to claim 2 wherein the arcuate stop of at least one of the first and second relief mechanisms is substantially semi-circular and returns relative to the stem section of the at least one relief mechanism an angle greater than 90°.

4. A carton according to claim 1 wherein the one or more weakened lines comprise a curved cut line, and wherein the frangible line is provided by a J-shaped cut line.

5. A carton according to claim 4 wherein the one or more weakened lines comprises a linked series which starts with a substantially linear crease at a location proximate the hinged connection and continues into the curved cut line, the curved cut line is separated from the J-shaped cut line by a connecting nick portion.

6. A carton according to claim 1 wherein the arcuate stop is disposed at a location spaced below a portion of the hinged connection, said portion of the hinged connection being disposed between the lifting edge and the line of separation.

7. A carton according to claim 1 wherein the stem section is disposed at a location spaced below a portion of the hinged connection, said portion of the hinged connection being disposed between the lifting edge and the line of separation.

8. A carton comprising a top panel, a first side panel and a slot handle formed in the top panel and the first side panel, the slot handle comprising a line of separation extending at least substantially transversely across the top panel into the first side panel, the slot handle comprising a lifting edge provided by the top panel and spaced from the line of separation, the slot handle further comprising a cushioning flap hinged to the lifting edge, the cushioning flap having an end portion formed from the first side panel, the slot handle further comprising a first stress relief mechanism provided in the first side panel, the first stress relief mechanism comprising a frangible line having a straight stretch that is disposed at an angle relative to a notional line disposed normal to a hinged connection between the top panel and the first side panel, the straight stretch extending downwards away from the end portion of the cushioning flap and terminating in an arcuate stop at a location spaced below the end portion.

9. A carton according to claim 8 wherein the end portion is hinged to the remainder of the cushioning flap by a fold line.

10. A carton according to claim 9 wherein the fold line is continuous with the hinged connection.

11. A carton according to claim 8 wherein the end portion is hinged to the first side panel along a fold line extending from the lifting edge.

12. A carton according to claim 11 wherein the straight stretch extends upwards from the arcuate stop toward the fold line.

13. A carton according to claim 8 wherein the line of separation is disposed at a location that is spaced from a centre of the top panel such that the top panel comprises a long side of the line of separation and a short side of the line of separation wherein the length of the top panel on the short side of the line of separation is less than the length of the top panel on the long side of the line of separation, the straight stretch extending toward the long side of the line of separation to reach the arcuate stop.

14. A blank for forming a carton, the blank comprising a top panel, a first side panel hinged to the top panel, and a slot handle formed in the top panel and the first side panel, the slot handle comprising a line of separation extending at least substantially transversely across the top panel into the first side panel, the slot handle comprising a lifting edge provided by the top panel and spaced from the line of separation, the slot handle further comprising a cushioning flap hinged to the lifting edge, the cushioning flap having an end portion formed from the first side panel, the slot handle further comprising a first stress relief mechanism provided in the first side panel, the first stress relief mechanism comprising a frangible line having a straight stretch that is disposed at an angle relative to a notional line disposed normal to a hinged connection between the top panel and the first side panel, the straight stretch extending away from the hinged connection and terminating in an arcuate stop at a location spaced from the end portion, wherein the end portion is hinged to the first side panel along a fold line extending from the lifting edge, wherein the straight stretch extends from the arcuate stop toward the fold line.

15. A blank according to claim 14 wherein the end portion is hinged to the remainder of the cushioning flap by the fold line.

16. A blank according to claim 15 wherein the fold line is continuous with the hinged connection.

17. A blank according to claim 14 wherein the line of separation is disposed at a location that is spaced from a centre of the top panel such that the top panel comprises a long side of the line of separation and a short side of the line of separation wherein the length of the top panel on the short side of the line of separation is less than the length of the top panel on the long side of the line of separation, the straight stretch extending toward the long side of the line of separation to reach the arcuate stop.

* * * * *